US011241103B2

(12) United States Patent
Griggs et al.

(10) Patent No.: US 11,241,103 B2
(45) Date of Patent: Feb. 8, 2022

(54) LED LIGHTING SYSTEM FOR HEATED ENCLOSURE

(71) Applicant: GILES ENTERPRISES, INC., Montgomery, AL (US)

(72) Inventors: Zachary Griggs, Decatur, GA (US); Lance Nicholas Covert, Montgomery, AL (US); Craig Scott Yost, Montgomery, AL (US)

(73) Assignee: Giles Enterprises, Inc., Montgomery, AL (US)

( * ) Notice: Subject to any disclaimer, the term of this patent is extended or adjusted under 35 U.S.C. 154(b) by 0 days.

(21) Appl. No.: 16/666,293

(22) Filed: Oct. 28, 2019

(65) Prior Publication Data

US 2020/0128972 A1 Apr. 30, 2020

Related U.S. Application Data

(60) Provisional application No. 62/751,417, filed on Oct. 26, 2018.

(51) Int. Cl.
*A47F 3/00* (2006.01)
*F21V 29/503* (2015.01)
(Continued)

(52) U.S. Cl.
CPC ..... *A47F 3/001* (2013.01); *A47F 7/0071* (2013.01); *F21V 29/503* (2015.01); *F21V 29/67* (2015.01); *F21V 29/773* (2015.01); *H05B 3/72* (2013.01); *F21W 2131/405* (2013.01); *F21Y 2115/10* (2016.08)

(58) Field of Classification Search
CPC ..... A47F 3/001; F21V 29/67; F21V 29/677; F21V 29/90
See application file for complete search history.

(56) References Cited

U.S. PATENT DOCUMENTS 7,954,979 B2 6/2011 Sommers et al.
8,021,023 B2 9/2011 Liu
(Continued)

FOREIGN PATENT DOCUMENTS

CN 108577363 A 9/2018
EP 2119968 A1 * 11/2009 ..... F24C 15/008
(Continued)

OTHER PUBLICATIONS

PCT/US2019/058349, Written Opinion of the International Searching Authority, dated Feb. 7, 2020.

*Primary Examiner* — Alexander K Garlen
(74) *Attorney, Agent, or Firm* — Jacob W Neu; Bradley Arant Boult Cummings LLP

(57) ABSTRACT

An enclosure or display cabinet for displaying heated objects (such as a food display module or container) using heat-sensitive lighting is disclosed herein. The heat-sensitive lighting may be, for example, an LED lighting unit. LED lighting is inefficient and tends to degrade or fail when operating at higher temperatures. However, LED lighting may be preferred as it is typically more energy efficient than other lighting options (such as incandescent bulbs). The lighting unit includes a thermally insulated space, shelf, or gap for housing the lighting and a system for reducing heat generated by the display or the lighting unit.

8 Claims, 5 Drawing Sheets

(51) Int. Cl.

| | |
|---|---|
| ***F21V 29/67*** | (2015.01) |
| ***A47F 7/00*** | (2006.01) |
| ***H05B 3/72*** | (2006.01) |
| ***F21V 29/77*** | (2015.01) |
| ***F21W 131/405*** | (2006.01) |
| ***F21Y 115/10*** | (2016.01) |

(56) References Cited

U.S. PATENT DOCUMENTS

| | | | | |
|---|---|---|---|---|
| 8,128,251 | B2 | 3/2012 | Huang et al. | |
| 9,157,675 | B2 | 10/2015 | Howington et al. | |
| 9,482,436 | B1 * | 11/2016 | Hettinger | F24C 15/008 |
| 9,557,004 | B1 * | 1/2017 | McGrath | F16M 13/02 |
| 9,615,676 | B2 | 4/2017 | Clark et al. | |
| 9,885,469 | B2 * | 2/2018 | Baumeister | F21V 29/503 |
| 2002/0005686 | A1 | 1/2002 | Nuttall et al. | |
| 2008/0192508 | A1 | 8/2008 | Busby | |
| 2012/0125911 | A1 * | 5/2012 | Shaffer | F24C 15/008 219/393 |
| 2012/0127729 | A1 * | 5/2012 | Brown | F21V 33/0044 362/310 |
| 2014/0292168 | A1 | 10/2014 | Nevarez | |
| 2015/0198366 | A1 | 7/2015 | Sanders et al. | |
| 2016/0100698 | A1 | 4/2016 | Clark et al. | |
| 2016/0320069 | A1 * | 11/2016 | Hettinger | F24C 15/008 |
| 2017/0350603 | A1 * | 12/2017 | Je | F21V 29/67 |
| 2018/0000259 | A1 | 1/2018 | Cichuta et al. | |
| 2018/0127150 | A1 | 5/2018 | Adanur et al. | |

FOREIGN PATENT DOCUMENTS

| | | | | |
|---|---|---|---|---|
| EP | 2481321 | B1 | 8/2012 | |
| EP | 2867581 | B1 * | 11/2016 | F21V 29/02 |
| JP | 2016200327 | A | 12/2016 | |
| WO | 2012165125 | A1 | 12/2012 | |
| WO | 2017149787 | A1 | 9/2017 | |
| WO | WO-2018001796 | A1 * | 1/2018 | F21V 3/061 |

* cited by examiner

LED LIGHTING SYSTEM FOR HEATED ENCLOSURE

TECHNICAL FIELD

This disclosure relates to a heated enclosure with lighting, which may be a food display case with LED lighting.

BACKGROUND ART

Like many types of lighting, LED diodes generate heat when at a brightness appropriate for lighting. Heat can also be a problem for LED diodes and circuitry. LED lighting becomes less efficient when the junction temperature increases. Higher junction temperature also tends to degrade the life or performance of LED lighting over time. Junction temperature is a function of the ambient temperature surrounding the LED, the current through the LED, and the presence and quality of a heatsink in or around the LED. Because of the role ambient atmospheric temperature plays in LED efficiency, LED lighting is generally prescribed for low temperature environments with application to higher temperature environments to be avoided.

A solution is needed for using LED lighting within heated enclosures.

SUMMARY OF THE INVENTION

In some respects disclosed herein is a container for objects to be maintained in a heated environment, having an enclosure having a top and an interior space; a canopy within the enclosure and separated from the top by a gap; a support surface in a heated space below the canopy, which is adapted to support objects; a heat-sensitive light source comprising a light-generating element positioned to direct light into an area beneath the canopy; and a heat sink coupled to the light source and positioned at least partially in the gap between the canopy and the top.

In other respects disclosed herein is a food display case having a display cabinet having a display wall and a second wall; a heating element positioned to maintain the temperature inside the display cabinet above the temperature of the surrounding environment; a heat-sensitive light-generating element positioned within the display cabinet; and a heat sink positioned outside of the display cabinet and connected to the light-generating element.

In other respects disclosed herein is a food display case having a heated compartment and an LED light within the heated compartment, the LED light connected to a heat sink that is disposed outside of the heated compartment.

In other respects disclosed herein is a food display case, having a food display cabinet; a heating element capable of elevating the temperature within the food display cabinet above ambient temperature; a top extending at least partially over the food display cabinet, which top contains an interior space; an LED diode connected to the top, which LED diode is within the food display cabinet and positioned to light objects within the food display cabinet; a heat sink within the interior space of the top, which heat sink is thermally connected to the LED diode; and a fan adapted to circulate air drawn from outside the food display case over the heat sink.

DETAILED DESCRIPTION OF THE INVENTION

Figure 1:
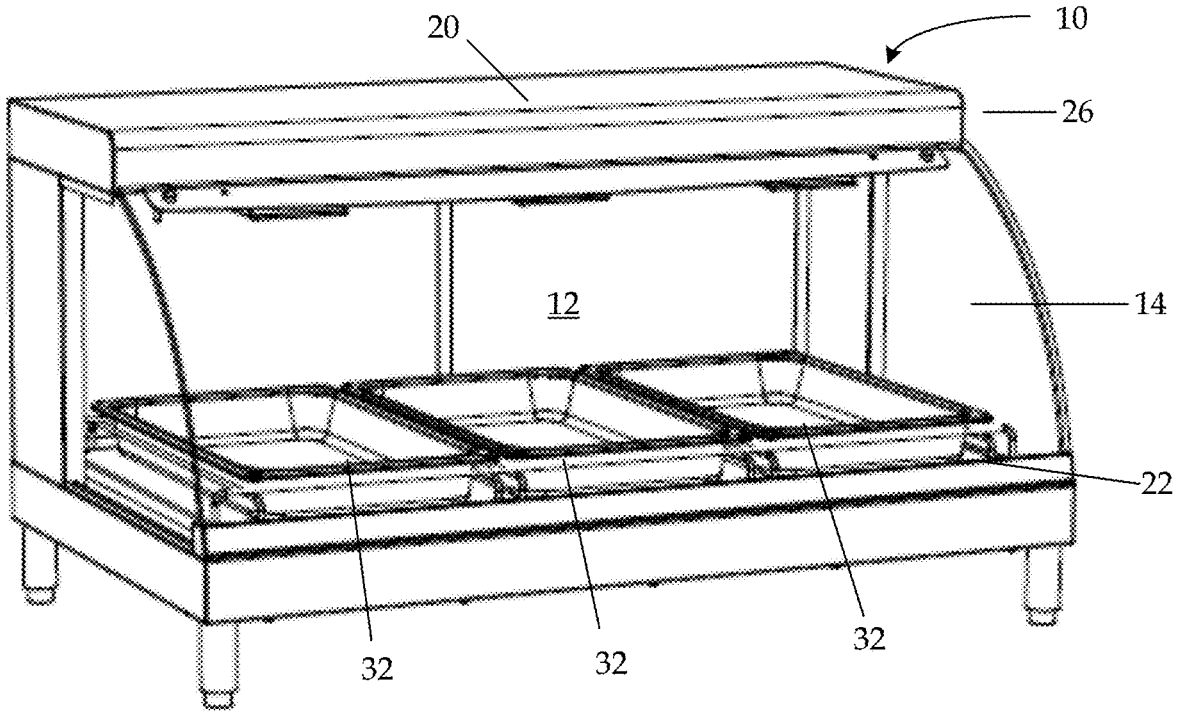
FIG. 1 is a front perspective view of a heated enclosure or display cabinet according to an embodiment of the invention.
Figure 2:
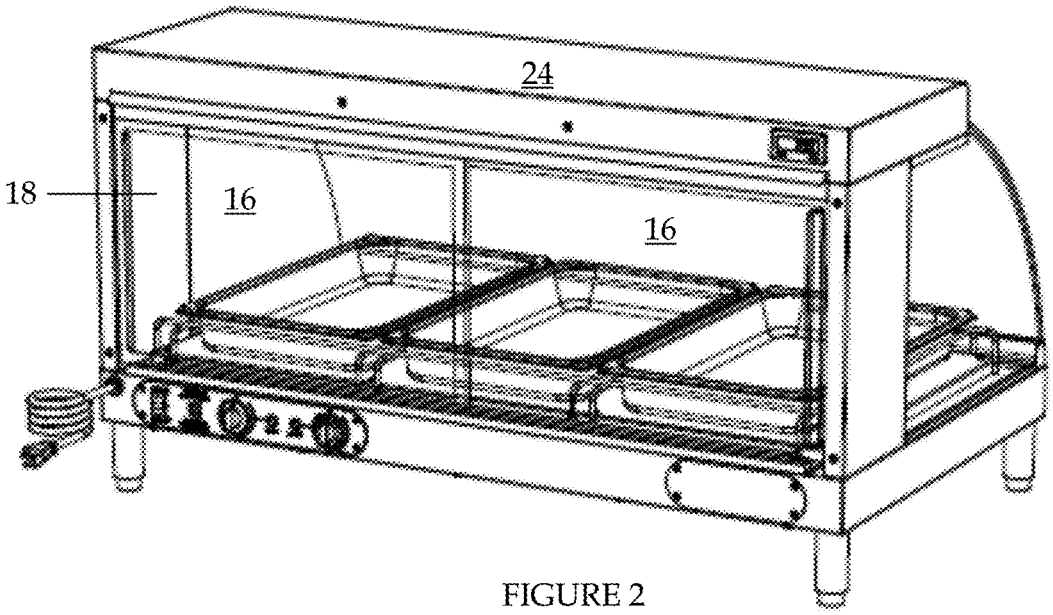
FIG. 2 is a rear perspective view of a heated enclosure or display cabinet according to an embodiment of the invention.

FIGS. 1 and 2 depict an enclosure, container, or display cabinet 10 such as those used for maintaining food or other products at a heated temperature. A heated enclosure 10 adapted to use lighting systems that generate heat or degrade due to heat (such as LED lighting) may be configured in various embodiments. At least a portion of the heated enclosure 10 is designated as a heated space 12 for containing a bounded heated volume having increased temperature relative to the ambient temperature surrounding the enclosure 10 generally. The heated space 12 may encompass the entire interior volume of the enclosure 10, or only a portion of the interior volume. In some embodiments, the heated space 12 may be fully enclosed, such as a display case with a front glass surface 14 and rear doors 16 that close to seal the enclosure. In other embodiments the heated space 12 may include one or more windows, doors, entryways, or partial walls that remain open during use. Non-limiting examples of such partially open heated spaces 12 include a "self-service" food display case or display cabinet 10 of the sort that has an open front facing the customer to allow the customer to reach in and take product without opening a door. Enclosures 10 having such partially-open heated spaces 12 are still considered enclosures for present purposes, as they serve to maintain a bounded area of increased temperature relative to the ambient temperature.

A partially-open enclosure 10 may be configured as a "self-service" case or an employee-serviced case. Employee-serviced cases are generally shown in the figures. In the self-service case, the front of the unit, which is the side intended to face customers, is generally open across a large percentage of its area, to allow one or more customers to reach into the heated space, possibly at the same time, without either opening a door or window, or requesting service from an employee. Doors and windows, or static or movable glass panels, may be included if desired. In the employee-serviced configuration, the front of the unit is typically enclosed by a pane 14 of transparent material such as glass, whereby customers may see the items inside the heated space 12 but are not able to retrieve them directly. The customer typically inquires of an employee for a particular item, following which the employee reaches in to the unit from an opening in the back (which may be closable by a door or window, such as a sliding rear access panel 16) to retrieve the product for the customer. Either configuration is amenable to the discussion herein.

Figure 3:
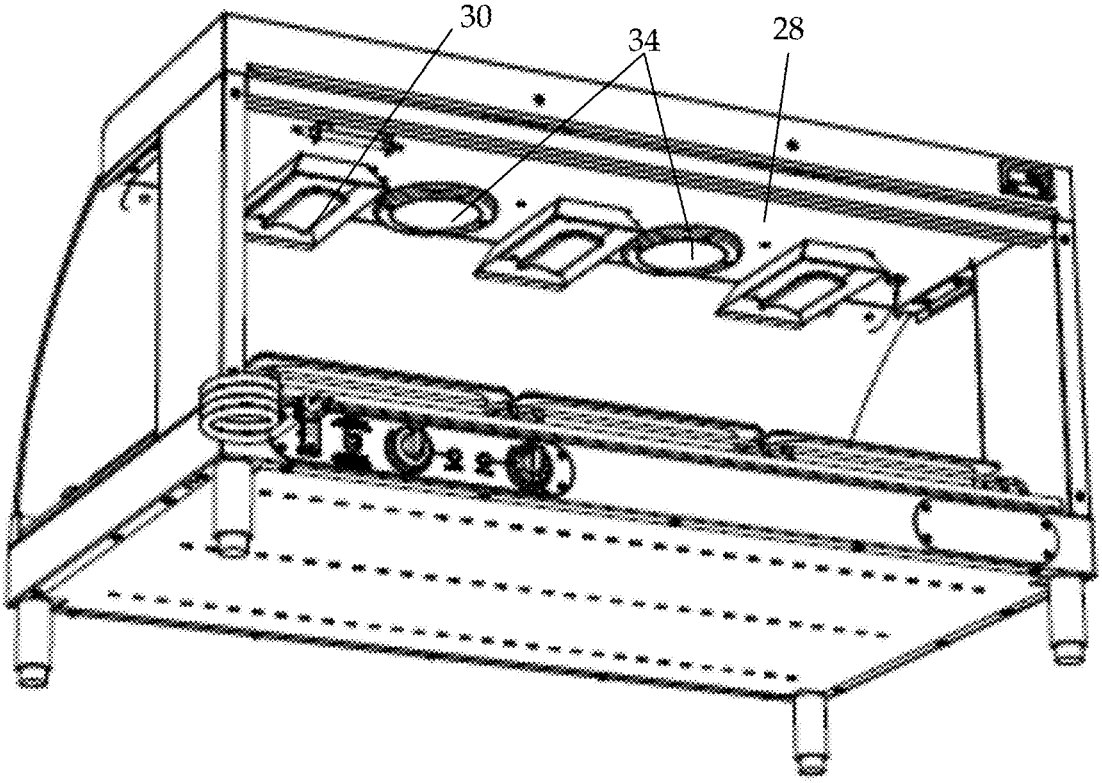
FIG. 3 is another rear perspective view of a heated enclosure or display cabinet according to an embodiment of the invention.
Figure 4:
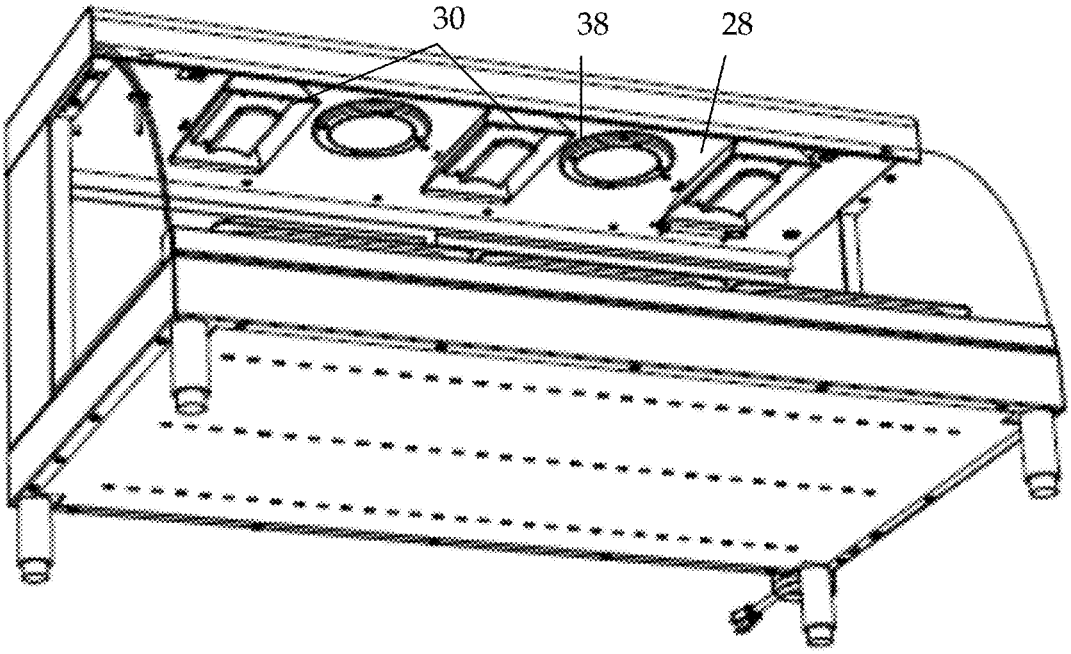
FIG. 4 is another front perspective view of a heated enclosure or display cabinet according to an embodiment of the invention.

In some embodiments, the heated enclosure 10 has an inner case 18 defining the heated space, and an outer casing 20 partially or wholly encompassing the inner case. For example, the inner case 18 may be the interior panels seen when looking into the food display case. The inner case 18 may have shelves, racks, and other support surfaces 22 for organizing products and labels. In some embodiments the outer casing 20 is or includes the exterior façade of the food display case. The exterior façade may be stainless steel panels or other materials that are cleanable using standard non-toxic soaps or cleaners. In some embodiments, mechanical and electrical parts, wiring, and other components as well as framing and other structural elements may be disposed between the inner case and the outer casing. Such embodiments keep the structural and electrical functional components out of sight and allow the visible portions of the outer casing 20 and the inner case 18 to provide an attractive presentation to the viewer. For some embodiments, the top 24 of the food display case 10 has the appearance of a counter top. Because of the need for wiring to lights or mechanicals between the inner case 18 and the outer casing 20, the top 24 of the food display case 10 may have a gap 26 between the inner top surface, or canopy 28, of the inner case 18 and the outer casing 20, sometimes on the order of a few inches. The canopy 28 is shown in FIGS. 3 and 4.

In some embodiments a heating element 30 may be disposed within the inner case 18 itself. The heating element 30 may be a ceramic heater, a heat lamp, a solar collector, a heat pump, a gas burner, or other heat source. In other embodiments, the heating element 30 may be disposed between the outer casing 20 and the inner case 18 in such a manner that the heat generated provides indirect heating into the inner case, such as by convection from beneath the inner case or by a blower directing heated air into the case. In some embodiments, the heating element 30 is a ceramic heater disposed within the inner case 18 itself, above the food product. Such an embodiment is shown in FIGS. 3 and 4, where the heating elements 30 are positioned above the trays 32. The heating element 30 may be recessed within cavities or depressions in the canopy 28 of the inner case 18, with the heating element 30 in direct communication with the air inside the inner case 18 and with wiring that runs into the gap 26 between the canopy 28 and the outer casing. 20 In some embodiments the heating element 30 may be integrated into and permanently attached to inner case 18. In other embodiments the heating element 30 may be a separate element that can be placed within or removed from the inner case 30 as and when desired, such as portable heating lamps.

The enclosure 10 has one or more lighting units 34, shown in FIGS. 3-6. In some embodiments the lighting may be one or more LED units having one or more LED diodes 36. Other lighting elements may also be used together with the LED diodes 36 or in place of the same, such as incandescent lamps, fluorescent lights, neon lighting, and other forms of light-emitting units.

The lighting units 34 may also be partially or completely disposed within the inner case. Flanges 38 or portions of light façade 36 may be visible on the canopy 28 inside the inner case 18, for example to facilitate attachment of the lighting unit 34 to the canopy 28 or to seal the opening into which the lighting unit 34 seats against the internal air in the inner case 18. A lens 40 may cover the lighting elements 36, to shield it from touching and food contamination. The lens 40 may or may not substantially insulate the lighting elements 36 from heat within the inner case 18. The LED diodes 36 may be within the heated inner case 18, whether covered by a lens or not. Lighting elements 36 that are covered by clear, transparent, or translucent lens, are considered within the heated inner case 18.

Particularly where the lighting element 36 is an LED diode, but also for other forms of lighting units 34, it is desirable to alleviate the heat conveyed to the lighting unit 34 from the heat within the inner case 18, as well as the heat generated by the lighting element 36 itself. A heat sink 42 may be affixed in thermal communication with the lighting unit 34. In some embodiments, the heat sink 42 is in close thermal communication to portions of the lighting unit 34 that are most sensitive to heat, such as the lighting element 36 itself (such as the diodes of an LED). The heat sink 42 may also be in thermal communication with other portions of the lighting unit 34 such as electronics associated with the control and operation of the lighting unit 34. In some embodiments, the heat sink 42 is at least partially outside of the inner case 18. In other embodiments, the heat sink 42 is mostly, almost entirely, or entirely outside of the inner case 18, and separated from the heated air that is within the inner case 18. In some embodiments, only so much of the heat sink 42 as is necessary to be in thermal communication with the lighting elements 36 of the lighting unit 34 is exposed to the air within the inner case 18. In some embodiments, the heat sink 42 may be located within the gap 26 between the inner case 18 and the outer casing 20, as shown for example in FIGS. 6-8 and 10. For example, the heat sink 42 may be placed in the gap 26 between the canopy 28 and the top 24 of the food display case 10. To increase the effectiveness of the heat sink 42 in drawing heat away from the lighting elements 36, the heat sink 42 may be placed close to the lighting elements 36. Depending on the configuration of the heating elements 30 and lighting elements 36, this may place the heat sink 42 in close proximity to other sources of heat within the inner case 18. When the heat sinks 42 are used to draw heat primarily or only from the lighting elements 36, the lighting element efficiency may be increased. To limit conduction of heat to the heat sink 42 from elements other than from the lighting elements 36 (or other parts of the lighting unit 34), heat isolating materials may be used. For example, the heat sink 42 may be thermally separated from the material of the inner case 18, to limit conduction of heat at that interface, by silicone gaskets, insulation, or other insulating or non-conductive materials that limit heat transfer. Gaskets 44 are advantageous in that they limit not only conduction but also direct intrusion of air from the inner case into the area around the heat sink, and thus also limit convection. Insulation 46 should also be used to limit transfer of heat.

The heat sink 42 may be located adjacent to and in thermal communication with the lighting element 36 of the lighting unit 34 (e.g., the LED diodes), yet thermally separated from the heated air present in the inner case 18. It is not necessary that the inner case 18 be hermetically sealed, or that the air around the heat sink 42 be incapable of exchanging with air that has been in the inner case 18, but it may be advantageous to limit the direct air flow, or to provide that the pathway for air between the heated environment of the inner case 18 and the area around the heat sink 42 is sufficiently distant that the air arriving at the heat sink 42 has had the opportunity to have cooled substantially toward ambient temperatures (e.g., by distance or by mixing with other air) before arriving at the heat sink 42.

Figure 5:
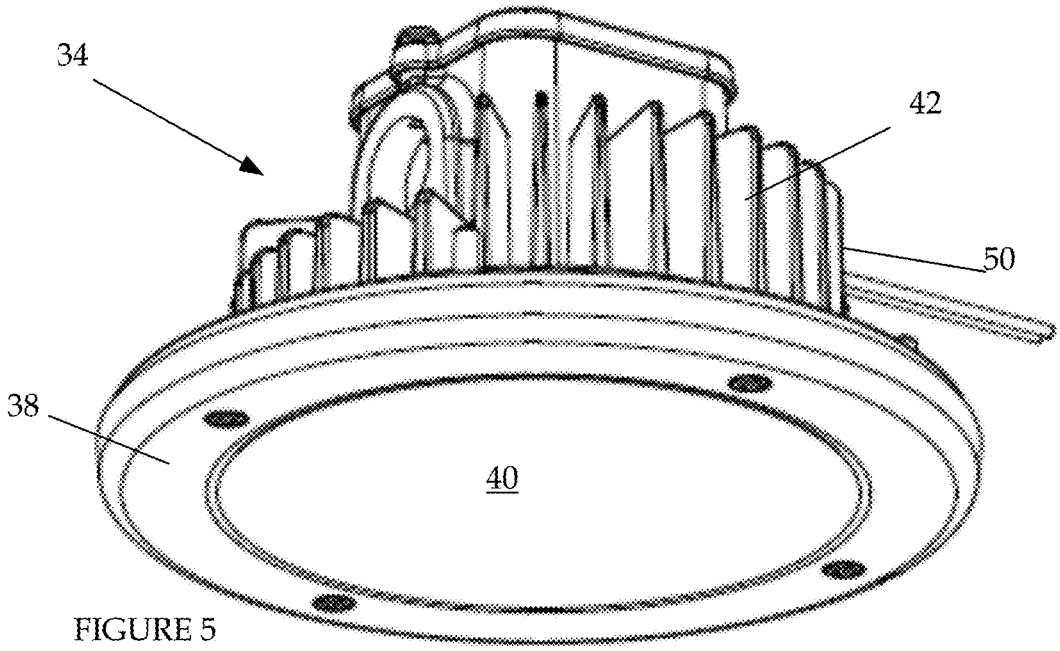
FIG. 5 is a view of a lighting unit having LED diodes (enclosed within the unit) according to an embodiment of the invention.
Figure 6:
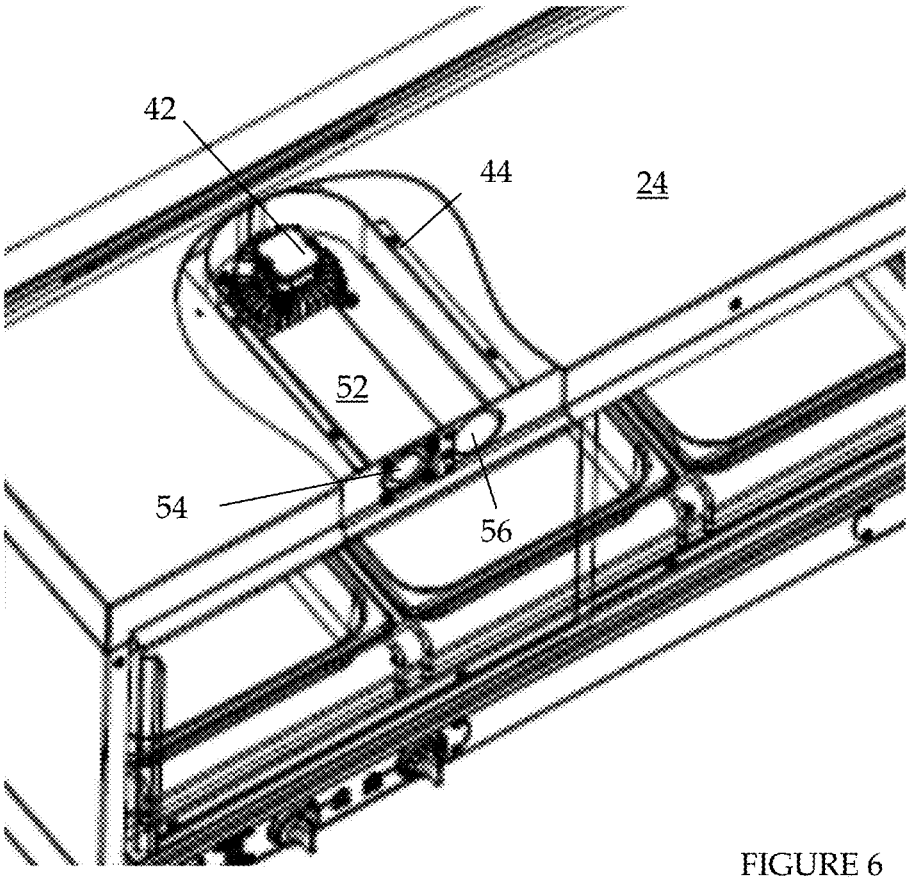
FIG. 6 is a top perspective view of a heated enclosure of display cabinet with cut-out showing a lighting unit and fan assembly according to an embodiment of the invention.

As shown in FIG. 5, the heat sink 42 may be formed integrally with the light unit 19. In some embodiments one or more LED diodes or other lighting elements 20 may be mounted into an extruded aluminum member. The extruded aluminum mounting acts as the heat sink 42 in such embodiments.

Figure 10:
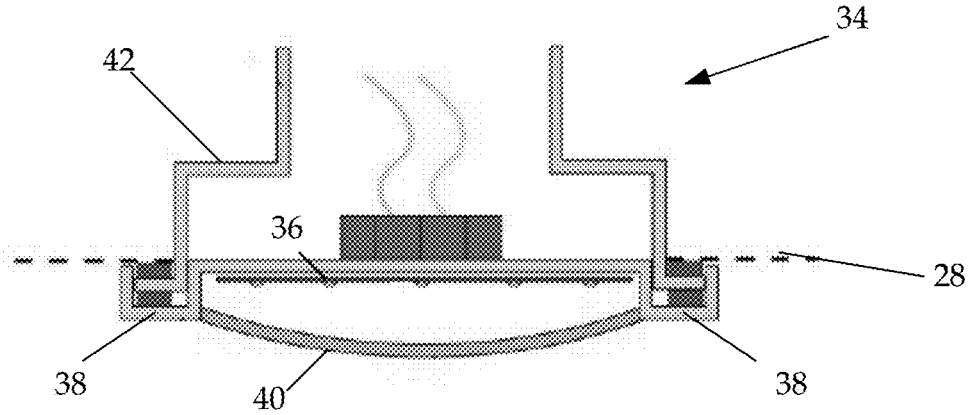
FIG. 10 shows a side plan view of a heat sink attached to an LED diode according to an embodiment of the invention.

In other embodiments the heat sink 42 may be screwed together with the LED or other lighting element 20, or attached to the LED or lighting element 20 by some other mechanism. FIG. 10 shows a cross-section of an LED 20 screwed into a heat sink 42.

Figure 7:
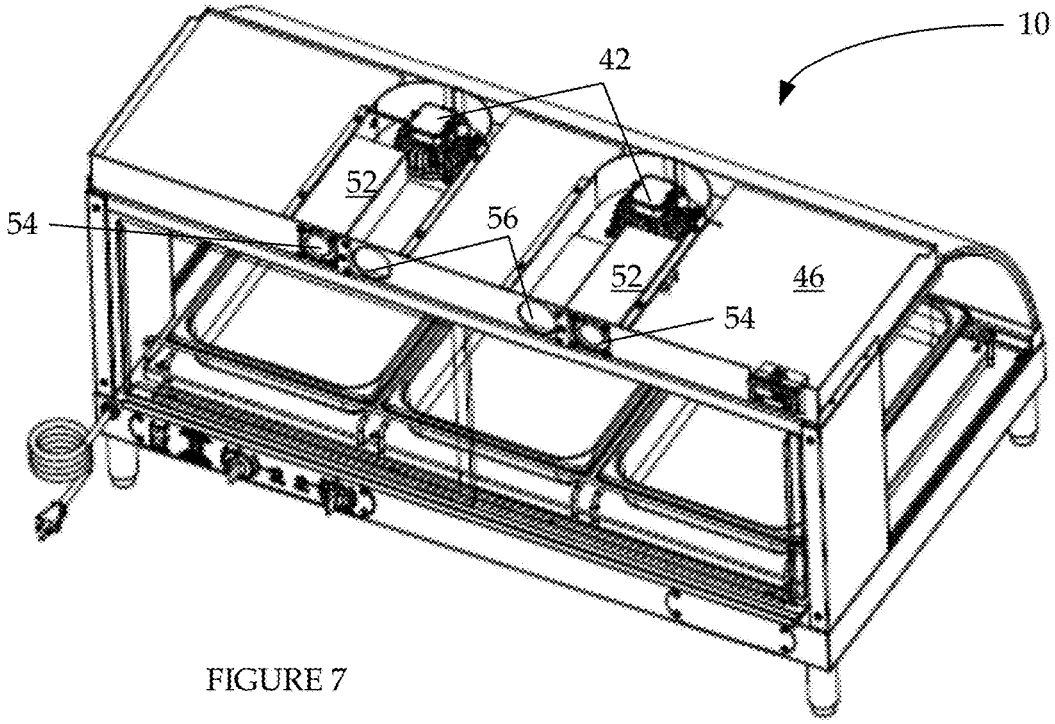
FIG. 7 is another top perspective view of a heated enclosure of display cabinet with the top removed and showing lighting units and fan assemblies according to an embodiment of the invention.
Figure 8:
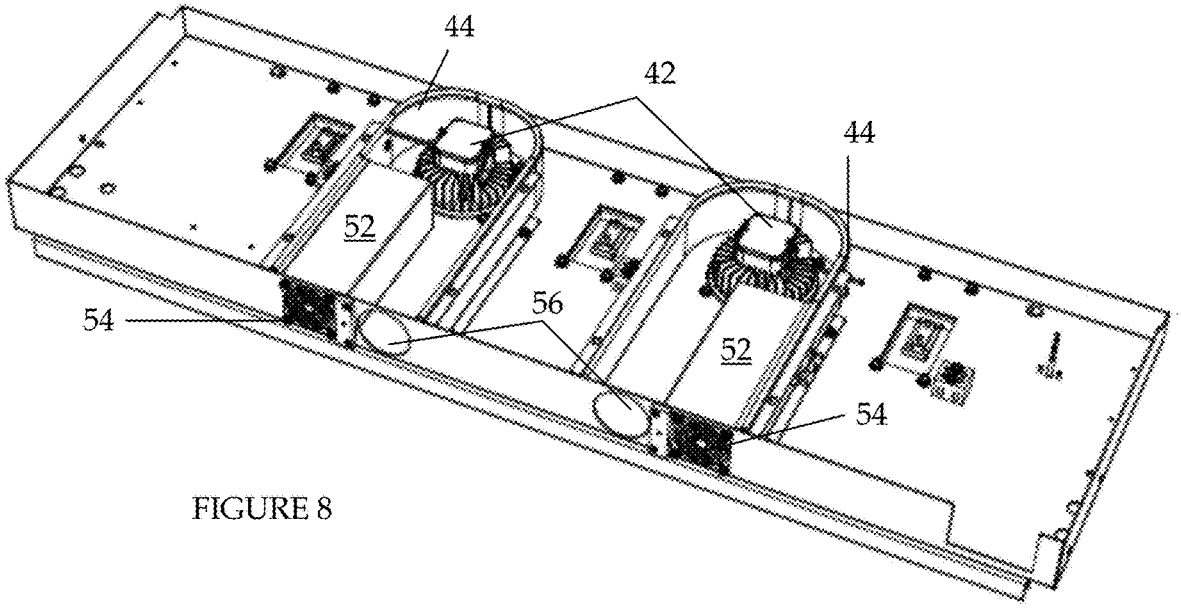
FIG. 8 shows a perspective view of the fan and lighting unit assemblies isolated in the gap above the canopy, according to an embodiment of the invention.

The efficiency of the heat sink 42 may be increased by moving air over the heat sink 42. In some embodiments the air may be room temperature, or otherwise the temperature of the ambient air. In other embodiments the air may be cooled prior to introducing it into proximity with the heat sink 42, which may further increase the efficiency of the heat sink 42. This can be accomplished by placing a fan 48 with its airflow directed across the surface of the heat sink 42, and particularly the fins 50 of the heat sink 42. Where the heat sink 42 has been placed between the inner case 18 and the outer casing 20, the fan 48 need not even be visible, but can be concealed if desired. For example, a channel 52 for airflow may be built into the area containing the heat sink 42, as shown in FIGS. 6-8, 10, and 13. To increase efficiency, if the inner case 18 has a persistently open cavity (such as a self-service case with the front open), the intake vent 54 may be placed at a location relatively distant from that opening, such as at the opposite side of the food display case 10 from that opening. If the food display case 10 has active venting, the intake vent 54 would ideally also be located away from such active venting. The fan 48 may be placed between the intake vent 54 and the heat sink 42, as shown in FIG. 8, such that it blows air onto the heat sink 42, or it may be placed in the airflow channel 52 after the heat sink 42. Such an embodiment would still have the effect of drawing air over the heat sink 42. The exhaust vents 56 from which air that has passed over the heat sink 42 exits the airflow channel 52 may be directed with less concern to placement. In some embodiments, the exhaust vent 56 will be substantially adjacent the intake vent 54, with the airflow channel 52 approximating a "U" shape, as depicted in FIGS. 7-8. In other embodiments, the exhaust vents 56 may be placed in such a way as to conceal their presence or function, such as at seams or vanes between panels of the food display case. A concealed intake vent 54 may reduce the amount of dust and debris, as the intake would not be easily reachable and the smaller confines would limit dust buildup. The exhaust vent 56 also can be concealed, if desired. In some embodiments, the intake vent 54 may be disposed in or adjacent channels that are also used to receive access panels, such as those that are associated with the operation of sliding doors 16 at the rear of the food display case that can be accessed by employees, as depicted in FIG. 7.

To provide further protection to the lighting unit 34, a switch can be installed that is responsive to temperature of the diode, the heat sink 42, or the area around the lighting unit 34 or a portion of it (such as the diode or lighting element 36). In the event the temperature exceeds a desired threshold, the switch can cut power to the lighting unit 34 to prevent its operation in the over-temperature state. In other embodiments the switch may cut power to the entire apparatus. For LED lighting, the desired threshold might be advantageously set at or around the temperature of 75° C., or such other temperature as conditions and the lighting unit recommend.

The figures and certain embodiments described above concern a gap 26 or shelf above the canopy 28 of the inner case 18 for mounting LED lighting units 34 enclosed within heatsinks 42 and capable of moving air through the space to increase the heating dispersion efficiency of the heat sinks around the LED lights. In other embodiments a similar shelf and space may be placed inside the inner case 18, forming one or more additional sets of shelves with lighting and heat sink capacity.

Figure 9:
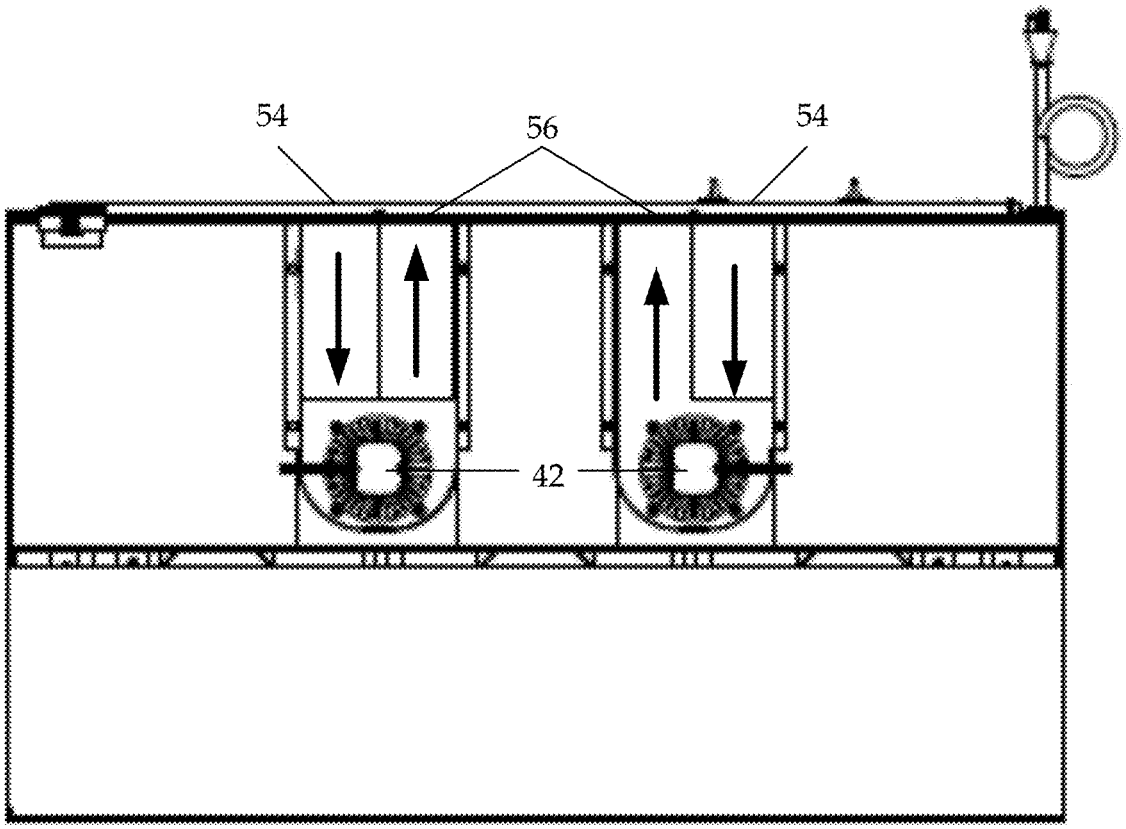
FIG. 9 shows a top plan view of the airflow according to an embodiment of the invention.

FIG. 9 shows the airflow through the channels 52 according to an embodiment of the apparatus. A fan located at the air intake vent blows air into the channel towards the heat sink 42. The air then continues to flow around the U-shaped channel and back out the exhaust vent.

FIG. 10 depicts a cut-through image of the lighting unit 34. An LED diode 36 with wiring is affixed within the heat sink 42 and placed substantially in alignment with the canopy 28 of the inner case. A lens 40 covers the LED diode 36. The lens may focus the light provided by the LED diode. The lends may also protect the LED diode from splashing liquids or inadvertent bumping while a user is moving about objects within the inner case. The lens 40 may also provide some insulation to the LED diode to protect against the heat in the heated space of the inner case. The heat sink 42 is attached to a flange 38 that surrounds the heat sink 42 and lens 40 and attaches the lighting unit 34 to the canopy 38. The flange may also have insulative qualities to reduce thermal exposure to the LED diode 36.

Some embodiments, or portions thereof, might be alternately or additionally described in the following ways. These descriptions are not exhaustive.

Some embodiments may be in the form of a container for objects to be maintained in a heated environment, having an enclosure having an interior space and a top; a canopy within the enclosure and separated from the top by a gap; a support surface in the space below the canopy, which is adapted to support objects; a light source having a light-generating element positioned to direct light into an area beneath the canopy; a heat sink coupled to the light source and positioned at least partially in the gap between the canopy and the top. Some of such embodiments may include a light-generating element which is or includes an LED diode. In some such embodiments, the gap between the canopy and the top is separated from the internal environment of the container. In some such embodiments, physical structures impede airflow directly from the internal environment of the container into the space between the canopy and the top. Some embodiments also comprise one or more walls enclosing the space between the canopy and the top, which walls limit a freedom of airflow into the space.

Other embodiments might be in the form of a container having an opening in the container through which objects may be retrieved by a user; and, at least one aperture in at least one of the walls, which aperture is located at a position or distance from the opening sufficient to limit air from the interior space entering the gap without first having reached approximately a temperature of the ambient air outside of the interior space. Among such embodiments, the opening may be configured to be substantially continuously open. The opening might be on a self-service side of the container configured to be substantially continuously open, whereby users can retrieve objects from the interior space without a door or window first being opened. Alternately, the opening could be a closable doorway or window.

In some embodiments the container may be in the nature of a food service display case that is adapted to be positioned between an employee-serviced location of a store and a customer area of a store, and wherein the opening is on the employee-serviced side of the container. In some embodiments, the vent may be on an opposite side of the container from the opening, and facing an opposite direction from the opening. In some embodiments, the vent may be on a back of the container, and the opening may be on a front of the container. An embodiment may further comprise a fan placed to force air into the vent. An embodiment might comprise a fan adapted to create positive pressure in the gap relative to the ambient pressure outside the container by circulating ambient air into the gap. A fan in any embodiment may be positioned to cause air to flow over the heat sink. In some embodiments, the fan may be positioned to circulate air from a vent on a back side of the container into the gap, across a surface of the heat sink, and out from the gap through an opening other than the vent.

Some embodiments of a container as discussed herein comprise a display side adapted to face potential purchasers, which display side allows objects present in the container to be viewed from outside the container. In some embodiments, walls join the top to the canopy, whereby the gap between the top and the canopy is substantially enclosed. For some embodiments, the wall on the display side of the container is free of air passages. For some embodiments, the walls adjacent to the wall on the display side each are also free of air passages. The container might also comprise an intake vent in at least one of the walls, an exhaust vent in at least one of the walls, and a fan disposed to circulate air into the space via the intake vent and out from the space via the exhaust vent. For this or other embodiments, the wall on the display side of the container may be free of intake vents and/or the wall on the display side of the container may be free of intake vents. For some embodiments, the fan is positioned to direct airflow over the heat sink In some embodiments of a container as discussed in this document, the heat sink is disposed entirely within the gap.

Some embodiments may be described as a food display case having a display cabinet; a heating element positioned to maintain the temperature inside the display cabinet above the temperature of the surrounding environment; a light-generating element positioned within the display cabinet; and a heat sink positioned outside of the display cabinet and connected to the light-generating element. Some of such embodiments may further comprise an outer casing around the display cabinet, and a fan between the outer casing and the display cabinet, wherein the fan is positioned to force air from the surrounding environment past the heat sink. Additionally or alternately, some of such embodiments may further comprise an intake vent in fluid communication with the fan, which intake vent is positioned on a side of the food display case, e.g., adapted to face away from customers.

Some embodiments might be in the form of a food display case having a heated compartment and an LED light within the heated compartment, with the LED light connected to a heat sink that is disposed outside of the heated compartment. In some such embodiments, the food display case may further comprise a fan positioned to direct airflow from a source other than the heated compartment over the heat sink.

Some embodiments may be in the form of food display case, having a food display cabinet; a heating element capable of elevating the temperature within the food display cabinet above ambient temperature; a top extending at least partially over the food display cabinet, which top contains an interior space; an LED diode connected to the top, which LED diode is within the food display cabinet and positioned to light objects within the food display cabinet; a heat sink within the interior space of the top, which heat sink is thermally connected to the LED diode; and a fan adapted to circulate air drawn from outside the food display case over the heat sink.

Some embodiments may be in the nature of component for a food display case (for example, a top panel, a side panel, etc.), having a first panel (e.g., a top surface, adapted to face outward from the food display case); a second panel separated from the first panel by a distance; a channel located between the first panel and the second panel; a lighting unit attached to the second panel in a position to direct light in a direction away from the first panel; a heat sink within the channel, which is thermally coupled to the light unit; and a fan positioned to circulate air from outside the component through the channel and across the heat sink. In some such embodiments, the lighting unit may comprise an LED. In some embodiments, the lighting unit may be connected to a thermal switch that is adapted to interrupt electrical power to the lighting unit when temperatures exceed a desired maximum.

We claim:

1. A food display container environment, comprising:

an enclosure having a top and at least two walls defining an interior space;

a canopy within the enclosure and separated from the top by a gap;

a support surface in a heated space below the canopy, which is adapted to support objects;

a display side having an opening in the display side through which objects may be displayed to and retrieved by a user;

a heat-sensitive light source comprising a light-generating element positioned to direct light into an area beneath the canopy; and a heat sink coupled to the light source and positioned at least partially in the gap between the canopy and the top;

wherein a fan is positioned to circulate air from a vent on a back side of the container on an opposite side of the container from the opening, across a surface of the heat sink, and out from the gap through an exhaust vent on the opposite side of the container from the opening.

2. The container of claim 1 further comprising a heat element adapted to maintain the heated space at a temperature higher than anticipated ambient temperatures.

3. The container of claim 1 wherein the light-generating element is an LED diode.

4. The container of claim 1 wherein the gap between the canopy and the top is separated from the internal environment of the container.

5. The container of claim 1, wherein the opening is on a self-service side of the container configured to be substantially continuously open, whereby users can retrieve objects from the heated space without a door or window first being opened.

6. The container of claim 1, wherein the opening is a closable doorway or window.

7. The container of claim 1, wherein the fan is adapted to create positive pressure in the gap relative to the ambient pressure outside the container by circulating ambient air into the gap.

8. The container of claim 1, wherein walls join the top to the canopy, whereby the gap between the top and the canopy is substantially enclosed.

* * * * *